US011278954B2

(12) United States Patent
Bai et al.

(10) Patent No.: US 11,278,954 B2
(45) Date of Patent: Mar. 22, 2022

(54) CASTING DEVICE OF LARGE NON-FERROUS METAL THIN-WALLED STRUCTURAL COMPONENT AND CASTING METHOD THEREOF

(71) Applicants: INNER MONGOLIA UNIVERSITY OF TECHNOLOGY, Inner Mongolia Autonomous Region (CN); BAOTOU XINKEFENG MACHINERY MANUFACTURING CO., LTD., Inner Mongolia Autonomous Region (CN)

(72) Inventors: Pucun Bai, Inner Mongolia Autonomous Region (CN); Xiaoming Cui, Inner Mongolia Autonomous Region (CN); Fei Liu, Inner Mongolia Autonomous Region (CN); Xiaohu Hou, Inner Mongolia Autonomous Region (CN); Fukui Liu, Inner Mongolia Autonomous Region (CN); Wenshu Zhao, Inner Mongolia Autonomous Region (CN)

(73) Assignees: INNER MONGOLIA UNIVERSITY OF TECHNOLOGY, Inner Mongolia Autonomous Region (CN); BAOTOU XINKEFENG MACHINERY MFG. CO., LTD., Inner Mongolia Autonomous Region (CN)

( * ) Notice: Subject to any disclaimer, the term of this patent is extended or adjusted under 35 U.S.C. 154(b) by 0 days.

(21) Appl. No.: 17/094,877

(22) Filed: Nov. 11, 2020

(65) Prior Publication Data

US 2021/0187603 A1 Jun. 24, 2021

(30) Foreign Application Priority Data

Dec. 18, 2019 (CN) ..... 201911307370.9

(51) Int. Cl.
*B22D 17/30* (2006.01)
*B22D 17/14* (2006.01)
(Continued)

(52) U.S. Cl.
CPC ..... *B22D 17/30* (2013.01); *B22D 17/14* (2013.01); *B22D 17/2218* (2013.01); *B22D 27/08* (2013.01)

(58) Field of Classification Search
CPC .... B22D 17/14; B22D 17/22; B22D 17/2218; B22D 17/30; B22D 18/04; B22D 27/08;
(Continued)

(56) References Cited

U.S. PATENT DOCUMENTS 6,460,604 B1 * 10/2002 Damm et al. ..... B22D 18/04 164/306
2002/0036072 A1 * 3/2002 Grolla ..... B22C 9/08 164/133
2019/0283122 A1 9/2019 Du et al.

FOREIGN PATENT DOCUMENTS

CN 103517776 A 1/2014
JP 2008-142735 A 6/2008

* cited by examiner

*Primary Examiner* — Kevin P Kerns
(74) *Attorney, Agent, or Firm* — Rankin, Hill & Clark LLP

(57) ABSTRACT

A casting device of a large non-ferrous metal thin-walled structural component. A liquid outlet of the casting device is communicated with a casting sand box. The casting device comprises an L-shaped liquid storage cylinder, a pressure supplying cylinder, and a crystallization treater. Protective gas with the first gas pressure can be inflated into the top of the L-shaped liquid storage cylinder. The pressure supplying cylinder and the L-shaped liquid storage cylinder are integrally connected to form a U-shaped tube connector. Protective gas with the second gas pressure can be inflated into
(Continued)

the top of the pressure supplying cylinder. A liquid inlet of the crystallization treater is communicated with the pressure supplying cylinder while a liquid outlet is communicated with the pouring system and the mold cavity. The crystallization treater is provided with a grain refining mechanism.

16 Claims, 6 Drawing Sheets

(51) Int. Cl.
*B22D 17/22* (2006.01)
*B22D 27/08* (2006.01)
*B22D 18/04* (2006.01)

(58) Field of Classification Search
CPC ..... B22D 18/06; B22D 33/00; B22D 39/02; B22D 39/06; B22D 41/00
USPC ..... 164/284, 303, 71.1, 260, 122, 133, 113, 164/119, 306
See application file for complete search history.

CASTING DEVICE OF LARGE NON-FERROUS METAL THIN-WALLED STRUCTURAL COMPONENT AND CASTING METHOD THEREOF

TECHNICAL FIELD

The present invention relates to the technical field of casting, and specifically, to a casting device of a large non-ferrous metal thin-walled structural component and a casting method thereof.

BACKGROUND

An aluminum-alloy bolster is a key part of the high-speed train bogie mechanism and is directly connected with a wheel running device through a damping mechanism. The bolster as the key component of the high-speed train is a typical complex-structure and thin-walled large aluminum alloy cast part. Additionally, the bolster is also a box type cast part. A complete cavity is formed in the bolster and is utilized as an air storage cavity of an air spring attached air cavity. The appearance size of the bolster cast part is 3068 mm*1315 mm*260 mm, the even wall thickness is in the range of 15-25 mm, the net weight is 710 kg, and the working pressure is 6 bar. Thus, the bolster is also a bulge cast part. The bolster bears the weight of the whole vehicle body. When the vehicle runs, the bolster is also a force-bearing cast part under the action of alternating load along with the bumping of the vehicle. Therefore, there are high technical requirements on the aluminum-alloy bolster cast part. The cast part needs to pass 100% X-ray detection. Its interior should not have any cracks, excessive air holes, and impurities. The round pinhole cannot exceed the fourth grade, the long pinhole cannot exceed the second grade, and the sponge-shaped porosity and the dispersed porosity cannot exceed the second grade. The size precision is GB/T6414-1999 level II. The internal cavity of the cast part should maintain the pressure when the pressure is equal to 6 bar. The internal pressure of the cast part should be reduced to 0.1 bar within 5 minutes. The maximum working pressure is 7 bar. To the sand mold casting, the mold is formed by an external sand mold and an internal sand mold. The main casting defect of the sand mold casting of a large box-type and thin-walled aluminum-alloy cast part is the nonstandard cast part porosity.

The sand mold casting of the large thin-walled aluminum-alloy cast part in the prior art has the following defects:

(1) The low-pressure casting is hard to cast the large cast part, only the small cast part. For example, according to the application (JP2008142735A, 20080626) filed by Nissan Motor Co., Ltd., a piston 11 is used to fill the melt in an injection cavity 9 into a mold cavity 5 from the bottom of the mold cavity in a vertical upward direction, wherein the capacity of the injection cavity 9 is limited. Additionally, according to the application (CN103517776A, 20140115) filed by Sintokogio, Ltd., a piston 20 is used to press the melt in an injection cavity of an injection sleeve 16 into a cross sprue 8 so as to horizontally fill the melt into a mold cavity 6. The injection cavity is used to obtain the pressure so as to fill the melt into the mold cavity. Such casting method is suitable for casting the small cast part, but not the aluminum-alloy bolster cast part with the net weight of 710 kg. Furthermore, there is a low-pressure casting method for an aluminum alloy wheel proposed by the application (US2019283122A1, 20190919) filed by Citic Dicastal Co., Ltd., wherein the top of a crucible is communicated with the mold cavity through multiple sprues 11 by a riser tube 13; the air pressure is utilized as the power to drive the melt to enter the mold cavity from the riser tube 13. Even though such method can be used for casting the large cast part, there is a problem of pressure hysteresis when the gas is acted on a large area of the liquid.

Or, the low-pressure casting device is suitable for casting the small cast part, but cannot fill the large cast part. The large low-pressure casting device is wasted if it is used for casting the small cast part, and has poor applicability.

(2) The low-pressure casting and the grain refining are independent steps, cannot be organically combined, and wait for each other. Because the injection cavity or the crucible cavity is fabricated by the crucible materials, the grain refining needs a process of cooling and physically crashing the grains. However, such process can only be completed singly in another step.

(3) It needs to create a casting device capable of combining the different casting techniques, such as the inclined rotation type filling, which is mature in the gravity casting technique. However, it should design a special casting device for greatly combining them with the low-pressure casting technique.

Therefore, to the casting of the large non-ferrous metal thin-walled structural component, the thorny problems urgent to be solved in the industry are: how to combine the advantages of different casting techniques, combine the inclined rotation type filling with the low-pressure casting, combine the inclined rotation type filling with the gravity casting, simultaneously conduct the filling and the grain refining, and help the small device to be applied to the filling of the large cast part.

SUMMARY

In view of the above defects, the objective of the present invention is to propose a casting device of a large non-ferrous metal thin-walled structural component and a casting method thereof.

The objective of the present invention is achieved as follows: a casting device of a large non-ferrous metal thin-walled structural component is proposed. A liquid outlet of the casting device is communicated with a casting sand box, and a pouring system and a mold cavity are communicated and are arranged in the casting sand box. The casting device comprises:

an L-shaped liquid storage cylinder, wherein protective gas with the first gas pressure can be inflated into the top of the L-shaped liquid storage cylinder; the L-shaped liquid storage cylinder is used for filling a stored molten metal into the mold cavity under the drive of the first air pressure;

a pressure supplying cylinder, wherein the pressure supplying cylinder and the L-shaped liquid storage cylinder are integrally connected; protective gas with the second gas pressure can be inflated into the top of the pressure supplying cylinder; the pressure supplying cylinder is used for maintaining the pressure and feeding the mold cavity through the crystallization treater;

a crystallization treater, wherein a liquid inlet of the crystallization treater is communicated with the pressure supplying cylinder while a liquid outlet is communicated with the pouring system and the mold cavity; the crystallization treater is provided with a grain refining mechanism for conducting micro-alloying treatment on the flowing molten metal;

The crystallization treater comprises a crystal rise part. The exit of the crystal rise part is vertically upward or downward.

Further, the L-shaped liquid storage cylinder comprises a vertical tube part and an L-extension part. The first gas flow path is arranged at the top of the vertical tube part. The top wall of the L-extension part and the pressure supplying cylinder are integrally connected. The pressure supplying cylinder is communicated with the L-extension part through the first passage. The pressure supplying cylinder is communicated with the crystallization treater through the second passage.

Further, the crystallization treater comprises a sequentially and integrally connected and communicated influent tapered adapter utilizing the first horizontal axis as the rotation axis, a crystallization treatment part utilizing the tilt axis as the rotation axis, a crystal rise part utilizing the vertical axis as the rotation axis, and an effluent adapter utilizing the second horizontal axis as the rotation axis. The first horizontal axis, the tilt axis, and the vertical axis are located on the same main plane $\Pi$, and the second horizontal axis is vertical to the main plane $\Pi$. The pressure supplying cylinder comprises an effluent countersink communicated with the second passage. The crystallization treater is inserted into the effluent countersink through the influent tapered adapter in a liquid seal manner to communicate with the pressure supplying cylinder.

Further, an L-shaped sprue rotatably sleeves the effluent adapter. The L-shaped sprue comprises a sequentially and integrally connected transfer sleeve and a main sprue. The side flanges are arranged on the two sides of the transfer sleeve. Liquid sealing asbestos is embedded in the end face of the side flange. The transfer sleeve sleeves the periphery of the effluent adapter. A cylinder part of a pressing end cap abuts against the effluent adapter and is fixedly connected with the effluent adapter through bolts, such that the side flanges of the transfer sleeve can relatively rotate and can also seal the molten metal.

Further, the casting sand box is arranged on a track car in an inclination manner. The back-side-wall lower corner of the casting sand box is fixedly connected with an insertion cone communicated with a sprue. The main sprue of the L-shaped sprue is inserted into the conical hole of the insertion cone and abuts against the wall of the casting sand box, such that the crystallization treater is communicated with the pouring system and the mold cavity.

Further, the casting sand box has an inclined butt joint state, a filling rotation state, and a horizontal pressure maintenance state. In the inclined butt joint state, the casting sand box on the track car rotates to form a casting angle of inclination with the horizontal plane and is communicated with the crystallization treater through the L-shaped sprue; in the filling rotation state, the casting sand box is vacuumized, the molten metal in the crystallization treater continuously flows into the mold cavity through the main sprue, and such filling process accompanies with an operation that the casting sand box and the insertion cone force the L-shaped sprue to rotate around the effluent adapter till the casting sand box is horizontal. In the horizontal pressure maintenance state, the pressure supplying cylinder provides the second gas pressure to force the molten metal in the mold cavity, the sprue and the main sprue in the pressure maintenance state till the pouring gate is solidified.

Further, the grain refining mechanism comprises an ultrasonic vibration mechanism and a cooling mechanism. The ultrasonic vibration mechanism comprises the first ultrasound and the second ultrasound. The first ultrasound is arranged at the connection part of the crystallization treatment part and the crystal rise part and is coaxial with the tilt axis. The second ultrasound is arranged at the top of the effluent adapter and is coaxial with the crystal rise part. The cooling mechanism comprises the first cooling mechanism and the second cooling mechanism sequentially in the molten metal flowing direction. The first cooling mechanism is arranged around the outer wall of the crystallization treatment part. The second cooling mechanism is arranged around the outer wall of the crystal rise part.

Further, the height of the vertical tube part is over double the height of the pressure supplying cylinder.

A casting method of the casting device of a large non-ferrous metal thin-walled structural component is proposed.

The exit of the crystal rise part 32 is vertically upward. The method comprises:

(1). abutting in an inclination manner: arranging the casting sand box on the track car in an inclination manner by forming an intersection angle, namely a casting angle of inclination $\alpha$, with the horizontal plane, wherein the casting sand box moves along the track with the track car; controlling the track car to move along the track till the pouring system is communicated to the crystallization treater;

(2). continuously micro-alloying:

starting the grain refining mechanism, controlling the temperature of the melt at the liquid inlet of the crystallization treater 30 to be 100-120° C. higher than the alloy liquidus temperature of the non-ferrous metal, and controlling the temperature of the melt at the liquid outlet to be 80-90° C. higher than the alloy liquidus temperature of the non-ferrous metal;

(3). filling accompanied with rotating:

communicating the L-shaped liquid storage cylinder with the crystallization treater by using the pressure supplying cylinder, pressurizing the top of the L-shaped liquid storage cylinder by a gas from the first gas flow path, filling the melt into the mold cavity till the mold cavity is completely filled with the melt; accompanying the whole filling process of the molten metal into the mold cavity, controlling the casting sand box to start rotating from the casting angle of inclination to be horizontal;

(4). maintaining the pressure till the pouring gate is sequentially solidified:

closing the communication of the pressure supplying cylinder with the L-shaped liquid storage cylinder while maintaining the communication with the crystallization treater, pressurizing the top of the melt in the pressure supplying cylinder by a gas from the second gas flow path, and finishing such pressure maintenance operation till a large aluminum-alloy thin-walled structural component is sequentially solidified to the pouring gate.

A gravity casting method of the casting device of a large non-ferrous metal thin-walled structural component is proposed.

The exit of the crystal rise part is vertically downward. The method comprises:

(1). abutting in an inclination manner: arranging the casting sand box on the track car in an inclination manner by forming an intersection angle, namely a casting angle of inclination, with the horizontal plane, wherein the casting sand box moves along the track with the track car; controlling the track car to move along the track till the pouring system is communicated to the crystallization treater;

(2). continuously micro-alloying:

starting the grain refining mechanism, controlling the temperature of the melt at the liquid inlet of the crystallization treater to be 100-120° C. higher than the alloy liquidus temperature of the non-ferrous metal, and controlling the temperature of the melt at the liquid outlet to be 80-90° C. higher than the alloy liquidus temperature of the non-ferrous metal;

(3). filling accompanied with rotating:

communicating the L-shaped liquid storage cylinder with the crystallization treater by using the pressure supplying cylinder, wherein at this time, the melt flows out of the crystallization treater under the action of gravity to fill the mold cavity till the mold cavity is completely filled with the melt; accompanying the whole filling process of the molten metal into the mold cavity, controlling the casting sand box to start rotating from the casting angle of inclination to the horizontal position;

(4). conducting gravity pressure maintenance till the pouring gate is sequentially solidified:

maintaining the communication of the pressure supplying cylinder with the L-shaped liquid storage cylinder and the crystallization treater, and finishing the gravity pressure maintenance till a large aluminum-alloy thin-walled structural component is sequentially solidified to the pouring gate.

The casting device of a large non-ferrous metal thin-walled structural component and the casting method thereof achieve the manufacture of large cast parts by using a small device, the low-pressure molding, and the high pressure feeding. The melt can be continuously micro-alloyed in the filling process. By using the above composite casting technique of low-pressure casting/gravity casting in combination with the inclined-rotation type filling, the mold cavity obtains the low vacuum degree (negative pressure) in a short time. So, the air in the sand mold cavity is reduced, and the air content of the aluminum alloy liquid is also reduced. The pressure is quickly formed after vacuum pouring, such that the cast part is crystallized under the pressure. Thus, the porosity of the cast part is reduced, the defects of shrinkage cavity and shrinkage porosity of the cast part are eliminated, and the high-quality aluminum-alloy bolster cast part is obtained.

REFERENCE SIGNS IN THE DRAWINGS

1—casting sand box, 2—insertion cone, 3—flexible car frame, 4—supporting bearing pad, 5—overlapping bearing pad, 6—inclined oil cylinder, 7—first gas flow path, and 8—second gas flow path;

10—L-shaped liquid storage cylinder, 11—vertical tube part, and 12—L-extension part;

20—pressure supplying cylinder, 21—first passage, 22—second passage, and 23—effluent countersink;

30—crystallization treater, 31—crystallization treatment part, 32—crystal rise part, 33—influent tapered adapter, 34—effluent adapter, 35—L-shaped sprue, 36—transfer sleeve, and 37—main sprite;

40—ultrasonic vibration mechanism, 41—first ultrasound, 42—second ultrasound, 43—ultrasonic transducer, 44—amplitude transformer, and 45—vibration head;

50—cooling mechanism, 51—first cooling mechanism, and 52—second cooling mechanism;

60—wall-scraping stirring part, 61—rotation driving part, 62—stirring cold shaft, and 63—wall-scraping screw.

DESCRIPTION OF THE EMBODIMENTS

The following describes the embodiments of the present invention in detail with reference to the accompanying drawings, but does not limit the scope of the present invention.

Embodiment 1

Figure 1:
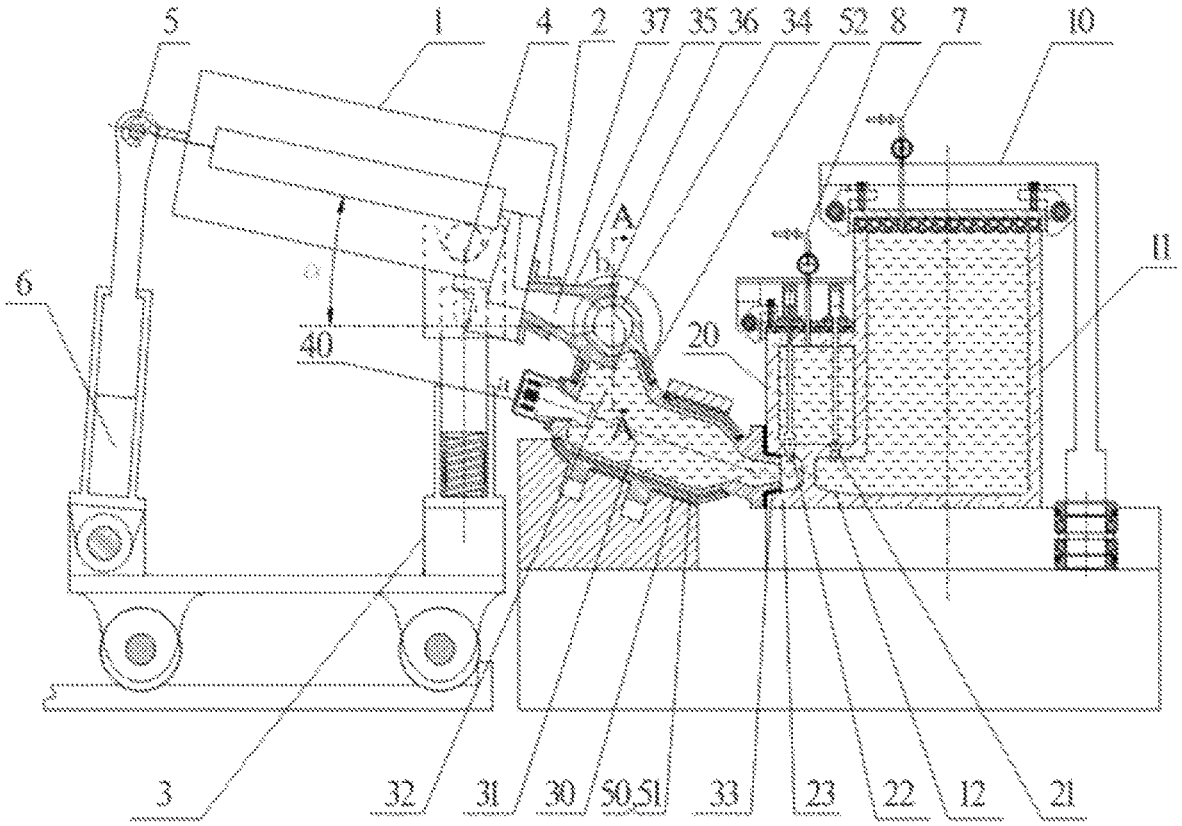
FIG. 1 is a main sectional view of Embodiment 1 of a casting device of a large non-ferrous metal thin-walled structural component of the present invention in a butt joint state.
Figure 2:
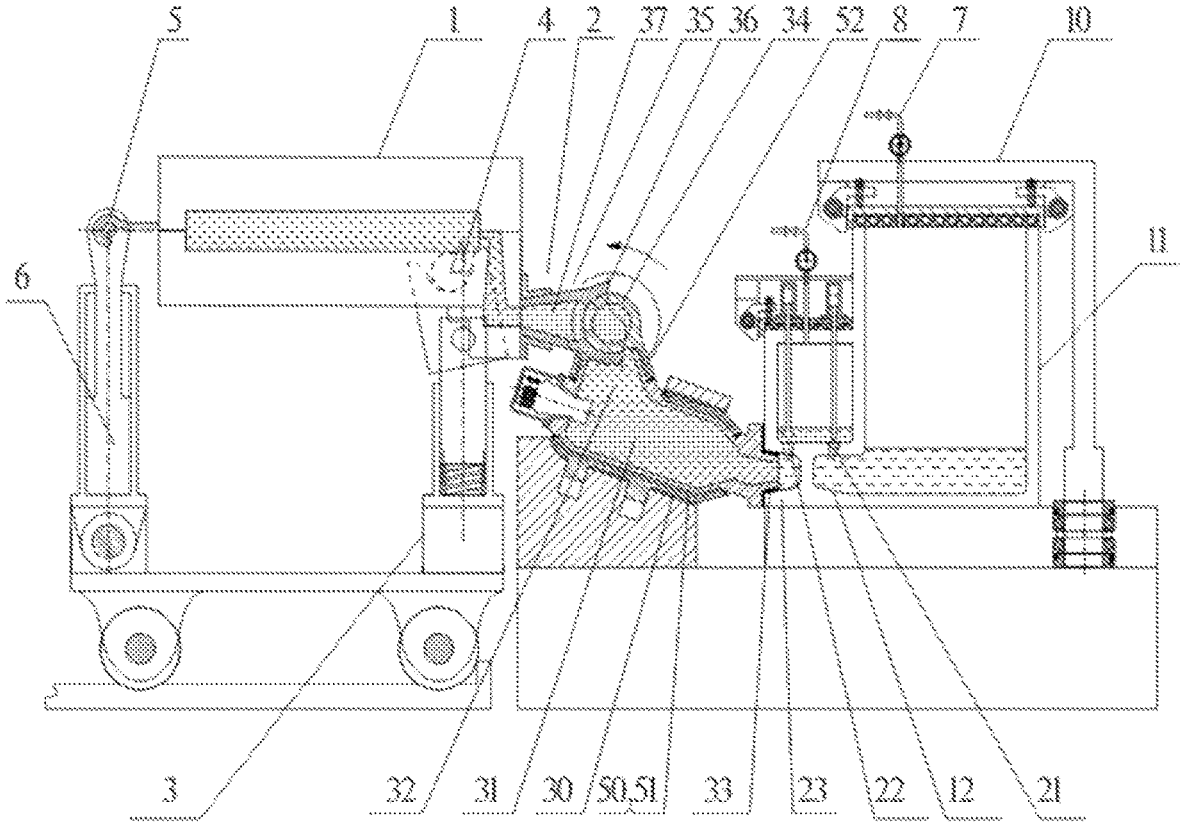
FIG. 2 is a main sectional view of Embodiment 1 of a casting device of a large non-ferrous metal thin-walled structural component of the present invention in filling rotation state.

As shown in FIG. 1 and FIG. 2, a casting device of a large non-ferrous metal thin-walled structural component comprises an L-shaped liquid storage cylinder 10, a pressure supplying cylinder 20, and a crystallization treater 30. The L-shaped liquid storage cylinder 10 comprises a vertical tube part 11 and an L-extension part 12. The pressure supplying cylinder 20 is integrally connected with the top wall of the L-extension part. The bottom of the pressure supplying cylinder 20 comprises the first passage 21 and the second passage 22 located on the two sides of the L-extension part. The pressure supplying cylinder 20 is communicated with the L-extension part of the L-shaped liquid storage cylinder 10 through the first passage 21. The pressure supplying cylinder 20 is communicated with the crystallization treater 30 through the second passage 22. The height of the vertical tube part 11 is over double the height of the pressure supplying cylinder 20.

The crystallization treater 30 comprises a sequentially and integrally connected and communicated influent tapered adapter 33 utilizing the first horizontal axis d as the rotation axis, a crystallization treatment part 31 utilizing the tilt axis a as the rotation axis, a crystal rise part 32 utilizing the vertical axis b as the rotation axis, and an effluent adapter 34 utilizing the second horizontal axis c as the rotation axis. The first horizontal axis d, the tilt axis a, and the vertical axis b are located on the same main plane Π, and the second horizontal axis c is vertical to the main plane Π. An intersection angle between the tilt axis a and the vertical axis b is in the range of 130-150 degrees. The pressure supplying cylinder 20 comprises an effluent countersink 23 communicated with the second passage 22. The crystallization treatment part 31 is inserted into the effluent countersink 23 through the influent tapered adapter 33 in a liquid seal manner to communicate with the pressure supplying cylinder 20.

The exit of the crystal rise part 32 is vertically upward for the low-pressure casting technique. Or, the exit of the crystal rise part 32 is vertically downward for the gravity casting technique.

An L-shaped sprue 35 rotatably sleeves the effluent adapter 34. The L-shaped sprue 35 comprises a sequentially and integrally connected transfer sleeve 36 and a main sprue 37. A liquid inlet communicated with the effluent adapter 34 is formed in the circumferential wall of the transfer sleeve 36. One end of the L-shaped sprue 35 is in insertion connection with the insertion cone 2 of the side wall of the casting sand box 1, and the other end thereof rotatably sleeves the effluent adapter 34 through the transfer sleeve 36, such that a transfer sprue communicates the crystallization treater with the main sprue of the casting sand box 1 and the mold cavity. The side flanges are arranged on the two sides of the transfer sleeve 36. Liquid sealing asbestos is embedded in the end face of the side flange. The transfer sleeve 36 sleeves the periphery of the effluent adapter 34. A cylinder part of a pressing end cap abuts against the effluent adapter and is fixedly connected with the effluent adapter through bolts adjustably. After the pressing end cap adjustably presses the transfer sleeve 36, the liquid sealing asbestos just presses the side flanges of the transfer sleeve 36, such that the side flanges of the transfer sleeve can relatively rotate and can also seal the molten metal.

The crystallization treater 30 is provided with a grain refining mechanism. The grain refining mechanism comprises an ultrasonic vibration mechanism 40 and a cooling mechanism 50. The ultrasonic vibration mechanism 40 comprises the first ultrasound 41 and the second ultrasound 42. The first ultrasound 41 is arranged at the connection part of the crystallization treatment part 31 and the crystal rise part 32 and is coaxial with the tilt axis a. The second ultrasound 42 is arranged at the top of the effluent adapter 34 and is coaxial with the crystal rise part 32. The ultrasonic vibration mechanism 40 comprises an integrally and sequentially connected ultrasonic transducer 43, the amplitude transformer 44, and a vibration rod. The vibration head 45 is coaxially fixed to the end part of the vibration rod. The cooling mechanism 50 comprises the first cooling mechanism 51 and the second cooling mechanism 52 sequentially in the molten metal flowing direction. The first cooling mechanism 51 is arranged around the outer wall of the crystallization treatment part 31. The second cooling mechanism 52 is arranged around the outer wall of the crystal rise part 32. Two folding cooling shells cover the outer wall of the crystallization treater 31. The continuous first cooling flow path is formed in the inner wall of the cooling shell. The effluent adapter 34 comprises an influent conical shell. The influent conical shell covers the outer wall of the crystal rise part 32. The continuous second cooling flow path is formed in the inner wall of the influent conical shell. The cooling temperatures of the first cooling mechanism 51 and the second cooling mechanism 52 are singly controlled.

All parts of the crystallization treater 30, including the crystallization treatment part 31, the crystal rise part 32, the influent tapered adapter 33, the effluent adapter 34, and the L-shaped sprue 35, are made from the refractory materials, such as ceramic, etc.

The casting sand box 1 is arranged on the track car in an inclination manner. The left side wall and the right-side wall of the casting sand box 1 rotatably overlap the supporting bearing pad 4 of a flexible car frame 3 on the two sides. The front side wall rotatably overlaps an inclined oil cylinder 6 through an overlapping bearing pad 5. The back-side-wall lower corner is fixedly connected with the insertion cone 2 communication with a sprue. The overlapping bearing pad 5 rotatably overlaps the horizontal rotating shafts of a piston of the inclined oil cylinder 6. The inclined oil cylinder 6 can drive the overlapping bearing pad 5 and the casting sand box 1 to rotate around the effluent adapter 34 for a certain angle.

The casting sand box 1 has an inclined butt joint state, a filling rotation state, and a horizontal pressure maintenance state. In the inclined butt joint state, the casting sand box 1 on the track car rotates through the inclined oil cylinder 6 corresponding to the supporting bearing pad 4 of the flexible car frame 3 to form a casting angle of inclination $\alpha$ with the horizontal plane. The casting angle of inclination a prefers in the range of 20-40 degrees, preferably about 25 degrees. To butt joint, the track car is controlled to move along the track till the main sprue 37 of the L-shaped sprue 35 is inserted into the conical hole of the insertion cone 2 and abuts against the wall of the casting sand box. So, the main sprue of the casting sand box and the mold cavity are communicated with the crystallization treater 30 through the main sprue 37. In the filling rotation state, the casting sand box 1 is vacuumized. The molten metal in the crystallization treater 30 continuously flows from the transfer sprue into the mold cavity through the sprue of the casting sand box. In such filling process, the piston of the inclined oil cylinder 6 shrinks, the casting sand box 1 and the insertion cone 2 are driven to force the L-shaped sprue 35 to rotate around the effluent adapter 34 till the casting sand box is horizontal. In the horizontal pressure maintenance state, the first passage 21 of the pressure supplying cylinder 20 is closed while the second passage 22 is opened. The pressure supplying cylinder 20 increases the gas pressure to force the molten metal in the mold cavity, the main sprue, and the transfer sprue in the pressure maintenance state till the pouring gate of the sprue is solidified.

A casting method of the casting device of a large nonferrous metal thin-walled structural component comprises:

1. Abutting in an inclination manner: arranging the casting sand box 1 on the track car in an inclination manner by forming the casting angle of inclination $\alpha$, wherein the casting sand box 1 moves along the track with the track car; controlling the track car to move along the track till the main sprue 37 of the L-shaped sprue 35 is inserted into the countersink of the insertion cone 2 and abuts against the wall of the casting sand box, and the main sprue of the casting sand box and the mold cavity are communicated to the crystallization treater 30 through the transfer sprue of the main sprue 37.

More preferably, the top end of the mold cavity of the casting sand box is connected with a vacuumizing device, such that the mold cavity obtains the low vacuum degree.

2. Continuously micro-alloying:

simultaneously starting the cooling mechanism 50 and the ultrasonic vibration mechanism 40, controlling the temperature of the melt at the liquid tapered adapter 33 of the crystallization treater 30 to be 100-120° C. higher than the liquidus temperature, and controlling the temperature of the melt at the exit of the effluent adapter 34 to be 80-90° C. higher than the alloy liquidus temperature; the shearing speed of the melt is in the range of 10-2000 s−1; the cooling strength is in the range of 500-5000 W/(m2*k).

The grain micro-alloying is achieved by cooperation of the ultrasound mechanism and the cooling mechanism. The first ultrasound 41 cooperates the first cooling mechanism 51. The second ultrasound 42 cooperates the second cooling mechanism 52.

3. Filling accompanied with rotating:

switching an the first passage 21 and the second passage 22 of the pressure supplying cylinder 20, pressurizing the top of the vertical tube part of the L-shaped liquid storage cylinder 10 by using the gas from the first gas flow path 8, and completing the filling till the melt is filled in the mold cavity through the main sprue 37 of the L-shaped sprue 35. When a large cast part such as an aluminum-alloy bolster with the net weight of 710 kg is filled, the liquid level of the interior of the vertical tube part is reduced horizontally. When a horizontal sensor detects that the liquid level is reduced to the lower limit of the liquid level, the first passage is closed. The gas from the second gas flow path 9 pressurizes the top of the melt in the pressure supplying cylinder 20. The melt continues to fill the mold cavity till the liquid level of the pressure supplying cylinder 20 is reduced to the lower limit of the liquid level; then, the filling of the melt into the mold cavity is completed. Moreover, the melt in the pressure supplying cylinder 20 is used up, and the liquid in the crystallization treater is pressed upwards into the mold cavity to fill the mold cavity. Accompanying the whole filling process of the molten metal into the mold cavity, the casting sand box 1 is controlled to start rotating around the second horizontal axis c of the effluent adapter 34 from the casting angle of inclination α to the horizontal position.

In view of the arrangement of the casting angle of inclination α, the sprue just faces to the position of a stiffener, such that the aluminum-alloy melt is filled in a laminar flow manner.

The liquid level of the L-shaped liquid storage cylinder 10 is horizontally reduced for maintaining the pressure till the pouring gate is sequentially solidified:

switching off the first passage 21 of the pressure supplying cylinder 20, and switching on the second passage 22; pressurizing the top of the melt in the pressure supplying cylinder 20 by a gas from the second gas flow path 9, and finishing such pressure maintenance operation till a large aluminum-alloy thin-walled structural component is sequentially solidified to the pouring gate.

Preparation of the aluminum-alloy melt is conducted while step 1 is conducted, The aluminum alloy prefers ENAC-42100T6 in the British Standard EN 1706, equivalent to the national ZL101A-T6. The preparation comprises:

(1) melting: adding aluminum-alloy ingot castings into an induction heating furnace to heat and melt; adding aluminum-titanium-boron intermediate alloy with the aluminum-alloy ingot castings; heating to melt under the protection of nitrogen, wherein the smelting speed is not less than 1000 kg/h to form the aluminum-alloy melt; each furnace contains about 1.5 t aluminum-alloy liquid under the protection of the inert gas; maintaining the temperature for 5-10 minutes; controlling the temperature of the melt to be 100-140° C. higher than the liquidus temperature; maintaining the temperature, standing for 5-10 minutes, then removing the surface dross, and pouring the melt into the refining furnace;

(2) refining: adding a certain amount of aluminum-silicon alloy modifier into the refining furnace; adding Cu and Mg to the wherein the aluminum-silicon alloy, blowing 99.99% argon into the aluminum-alloy melt from the bottom of an induction heating furnace, maintaining the temperature, and standing for 10-30 minutes; then, pouring the melt into the L-shaped liquid storage cylinder 10; switching on the first passage 21 and the second passage 22 of the pressure supplying cylinder 20 till the melt is fully filled with the top of the crystallization treater 30; then, switching off the second passage; continuously storing the aluminum-alloy melt till the vertical tube part is full of the melt; controlling the temperature of the melt to be 100-120° C. higher than the liquidus temperature.

By using the above composite casting technique of low-pressure casting in combination with the inclined-rotation type filling, the mold cavity obtains the low vacuum degree (negative pressure) in a short time. So, the air in the sand mold cavity is reduced, and the air content of the aluminum alloy liquid is also reduced. The pressure is quickly formed after vacuum low-pressure pouring, such that the cast part is crystallized under the pressure. Thus, the porosity of the cast part is reduced, the defects of shrinkage cavity and shrinkage porosity of the cast part are eliminated, and the high-quality aluminum-alloy bolster cast part is obtained.

Figure 6:
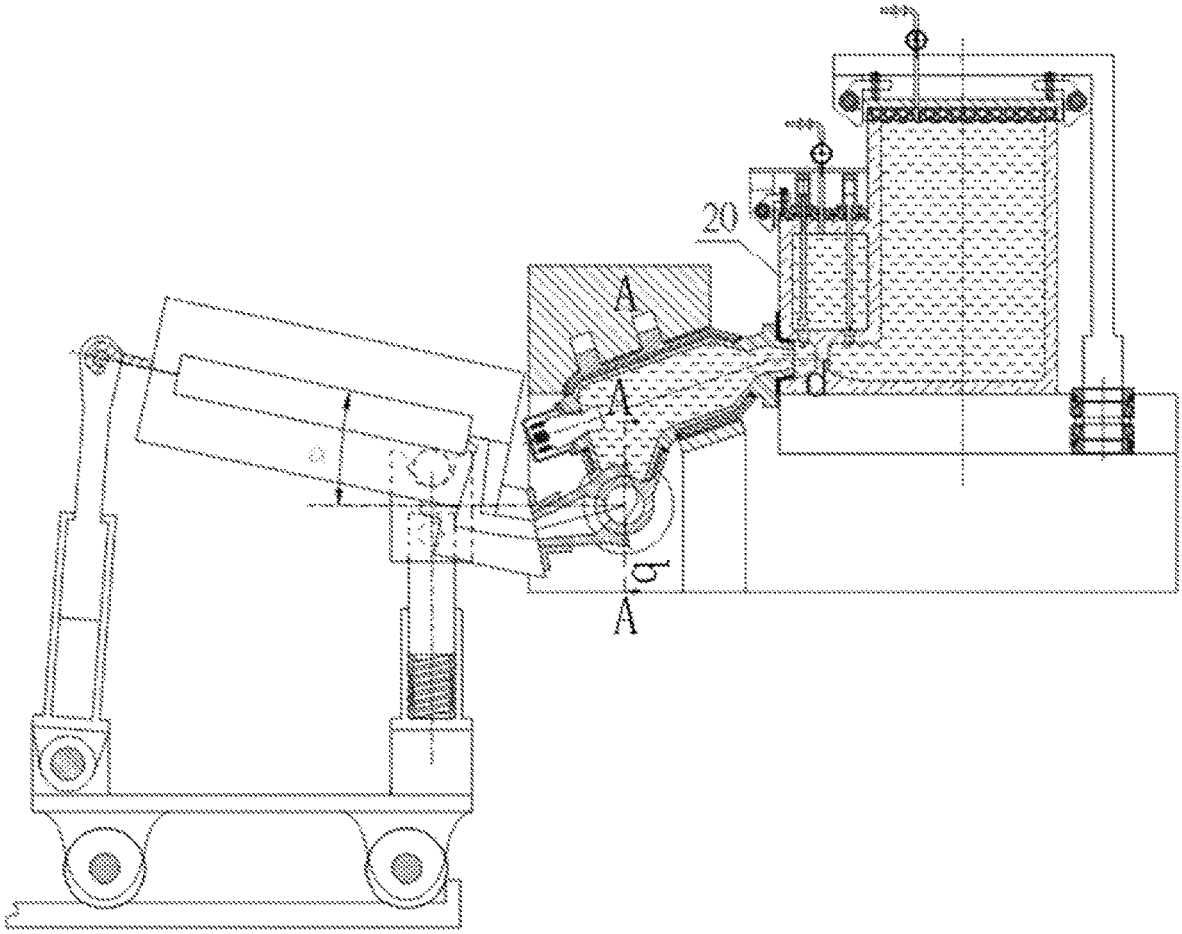
FIG. 6 is a main sectional view of a casting device of a large non-ferrous metal thin-walled structural component of the present invention when it applied to the inclined rotation type gravity casting technique.

As shown in FIG. 6, a gravity casting method of the casting device of a large non-ferrous metal thin-walled structural component comprises:

The exit of the crystal rise part 32 is vertically downward. The pressing end cap of the transfer sleeve 36 is provided with a plunger valve.

(1). Abutting in an inclination manner: arranging the casting sand box 1 on the track car in an inclination manner by forming an intersection angle, namely a casting angle of inclination α, with the horizontal plane, wherein the casting sand box 1 moves along the track with the track car; controlling the track car to move along the track till the pouring system is communicated to the crystallization treater 30.

(2). Continuously micro-alloying:

starting the grain refining mechanism, controlling the temperature of the melt at the liquid inlet of the crystallization treater 30 to be 100-120° C. higher than the alloy liquidus temperature of the non-ferrous metal, and controlling the temperature of the melt at the liquid outlet to be 80-90° C. higher than the alloy liquidus temperature of the non-ferrous metal.

3. Filling accompanied with rotating:

communicating the L-shaped liquid storage cylinder 10 with the crystallization treater 30 by using the pressure supplying cylinder 20, wherein at this time, the melt flows out of the crystallization treater under the action of gravity to fill the mold cavity till the mold cavity is completely filled with the melt; accompanying the whole filling process of the molten metal into the mold cavity, controlling the casting sand box 1 to start rotating from the casting angle of inclination α to the horizontal position.

(4). Conducting gravity pressure maintenance till the pouring gate is sequentially solidified:

maintaining the communication of the pressure supplying cylinder 20 with the L-shaped liquid storage cylinder 10 and the crystallization treater 30, and finishing the gravity pressure maintenance till a large aluminum-alloy thin-walled structural component is sequentially solidified to the pouring gate; after the casting system is solidified, using the plunger valve to seal the liquid outlet of the transfer sleeve 36; moving the track car and the casting sand box away to wait for the abutting in an inclination manner of the next casting sand box.

The large aluminum-alloy thin-walled structural component is the aluminum-alloy bolster cast part, and its mold interior is provided with multiple spaced laminated thin mold cores in the length direction. A narrow cavity is formed between the every two thin mold cores. The width of the narrow cavity is equal to the thickness of the wall of the reinforcing rib. The thin mold core is shaped by utilizing high-collapsibility phenolic urethane resin sand. The first core head is respectively arranged at the two ends of the thin mold core in the length direction. The lower surface is integrally connected with the second core head. The second core head is inserted into the lower laminated thin mold core to form the narrow cavity.

Embodiment 2

The crystal refining mechanism of the crystallization treater 30 is improved. The other structure is the same as that in Embodiment 1.

Figure 3:
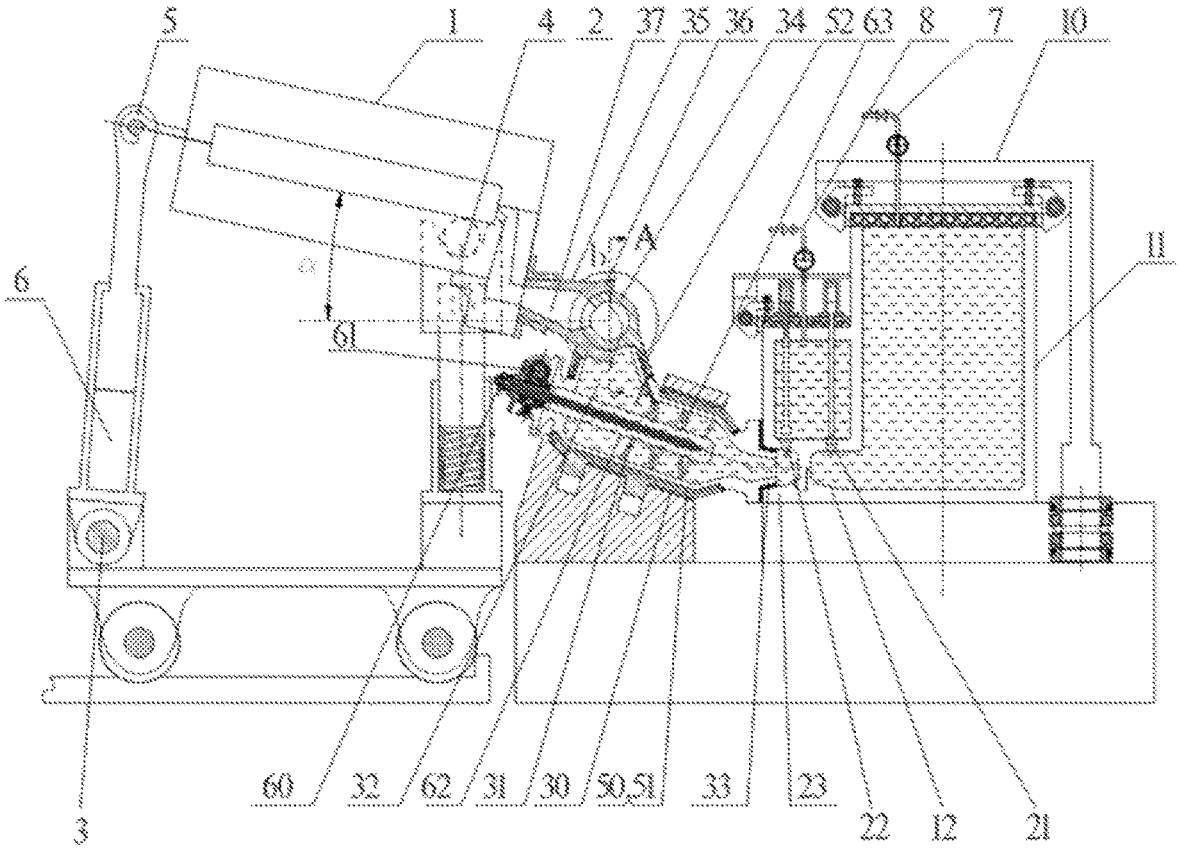
FIG. 3 is a main sectional view of Embodiment 2 of a casting device of a large non-ferrous metal thin-walled structural component of the present invention in a butt joint state.
Figure 4:
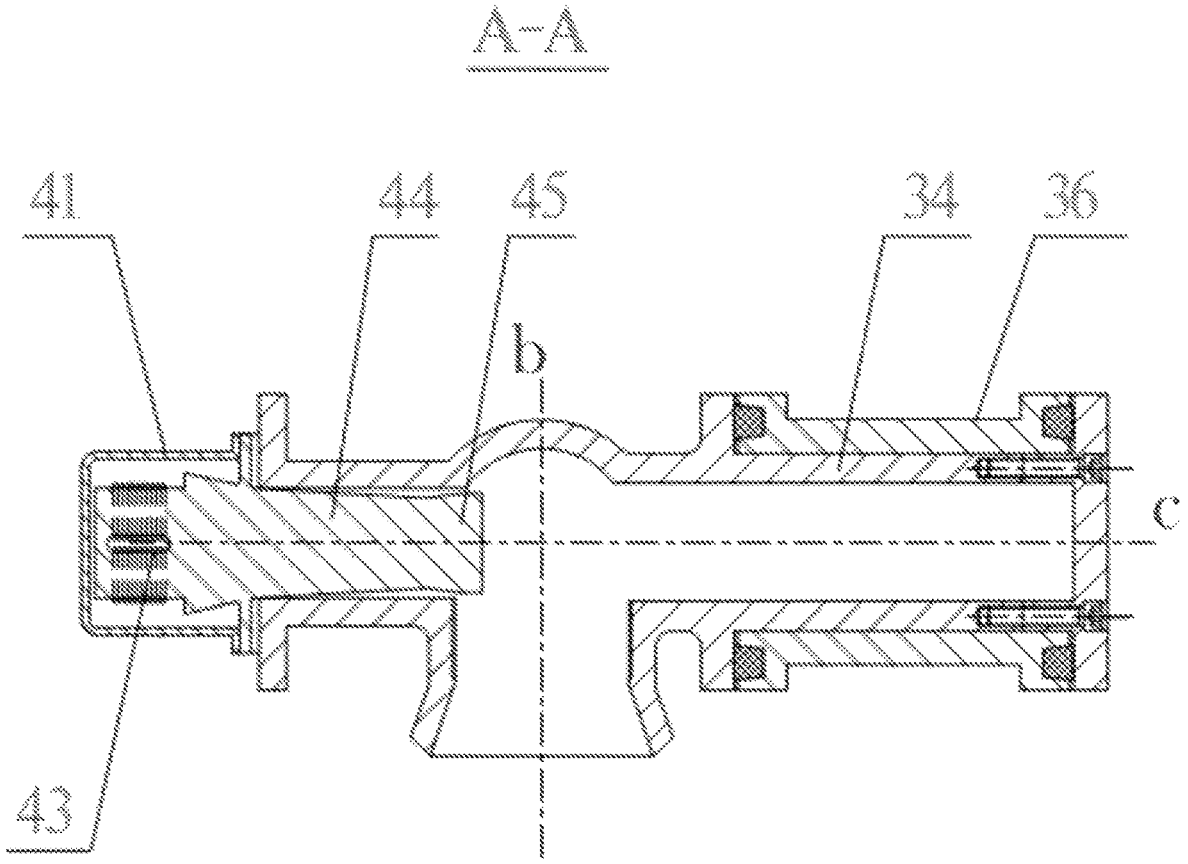
FIG. 4 is a sectional view of the casting device of a large non-ferrous metal thin-walled structural component of the present invention in the A-A direction of FIG. 3.
Figure 5:
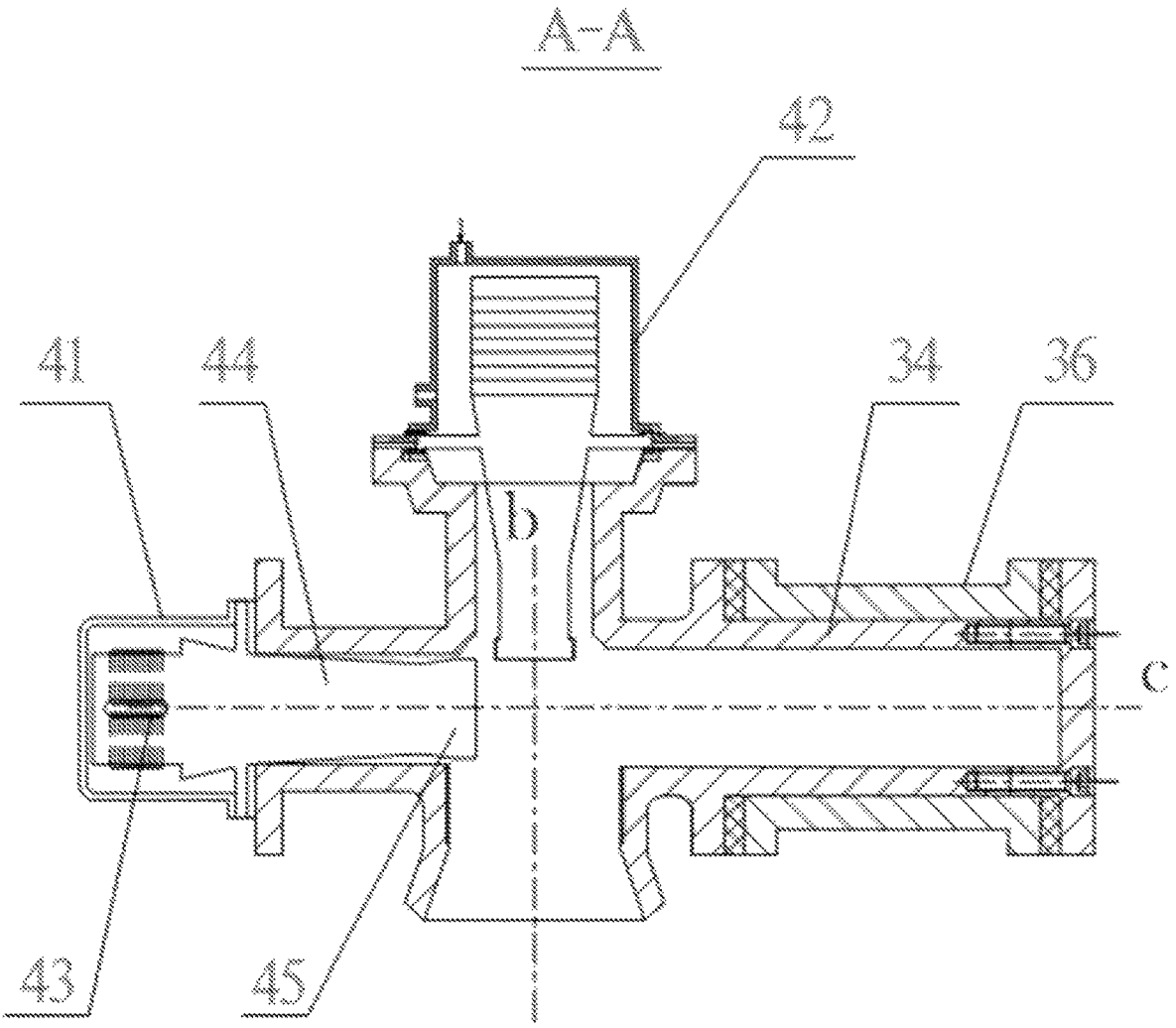
FIG. 5 is a sectional view of the casting device of a large non-ferrous metal thin-walled structural component of the present invention in another ultrasonic arrangement manner in the A-A direction of FIG. 3.

As show in FIG. 3 to FIG. 5, the casting device of a large non-ferrous metal thin-walled structural component is proposed. Besides the ultrasonic vibration mechanism 40 and the cooling mechanism 50, the crystal refining mechanism further comprises a wall-scraping stirring part 60. The wall-scraping stirring part 60 is coaxial with the tilt axis a and is arranged at the connection part of the crystallization treatment part 31 and the crystal rise part 32. The wall-scrapping stirring part 60 comprises a rotation driving part 61 and the stirring cold shaft 62. The stirring cold shaft 62 is connected with the rotation driving part 61. A wall-scraping screw 63 is arranged on the outer wall of the stirring cold shaft 62. A cooling passage is formed in the stirring cold shaft 62. The wall-scrapping screw 63 is in clearance fit with the inner wall of the crystallization treatment part 31.

The ultrasonic mechanism 40 is coaxial with the second horizontal axis c and is arranged on the outer wall of the effluent adapter 34. More preferably, the ultrasonic mechanism 40 further comprises the first ultrasound 41 and the second ultrasound 42. The first ultrasound 41 is coaxial with the second horizontal axis c and is arranged on the outer wall of the effluent adapter 34. The second ultrasound 42 is coaxial with the axis of the crystal rise part 32 and is vertically arranged on the outer wall of the effluent adapter 34.

The casting device of a large non-ferrous metal thin-walled structural component of the present invention solves the technical problems "how to combine the advantages of different casting techniques, for example, the inclined rotation type filling is combined with the low-pressure casting, and the inclined rotation type filling is combined with the gravity casting; how to combine the filling with the grain refining; how to make the small device to be capable of filling the large cast part."

1. The Effluent Adapter 34 and the L-Shaped Sprue 35 can Rotate to Discharge the Liquid.

The crystal rise part of the crystallization treater 30 is connected with the effluent adapter 34 utilizing the second horizontal axis c as the rotating axis. The L-shaped sprue 35 rotatably fits the effluent adapter 34. At the casting angle of inclination $\alpha$, the liquid inlet of the L-shaped sprue 35 just faces to the liquid outlet of the effluent adapter 34. Because the liquid inlet and the liquid outlet rotate for a certain angle by utilizing the second horizontal axis as the center to form a sector-shaped opening, when the L-shaped sprue 35 rotates around the effluent adapter 34 to the horizontal position, 80% area of the liquid inlet of the L-shaped sprue 35 still faces to the liquid outlet of the effluent adapter 34 to form the rotatable discharge design. After the inclination type abutting is completed, the inclined rotation type filling, namely filling accompanying with the rotating, can be achieved.

The low-pressure casting in the prior art generally adopts an upper mold cavity. The molten metal enters the sprue through the riser pipes to fill the mold cavity. The liquid level is increased to expel the air in the mold cavity. Thus, the low-pressure casting is hard to combine with the inclined rotation type filling. However, the top of the crystallization treater of the present invention is fixedly connected with the effluent adapter 34 utilizing the horizontal axis as the rotating axis, and the L-shaped sprue 35 rotatably sleeves the effluent adapter 34; thus, the rotation does not influence the flow out of the melt.

2. The Crystallization Treater is Adjustably Arranged Between the Crucible and the Casting Sand Box.

(1). The crystallization treater is arranged between the crucible and the casting sand box, such that it is possible to refine the crystal f the melt before the melt is filled into the mold cavity. So, the casting device has the ability of controlling the crystal size of the material. For example, under the combined action of the cooling mechanism and the ultrasonic mechanism, the isometric crystals are formed. So, the performance of the cast part can be improved, (2). An integral crucible of the L-shaped liquid storage cylinder and the pressure supplying cylinder is rotatably adjusted, is fixedly connected, and can be applied to the low-pressure casting or the gravity casting.

The L-shaped liquid storage cylinder and the pressure supplying cylinder are integrated crucible and can be used for storing the alloy melt. The exit of the crystal rise part is vertical upward, and can be applied to the low-pressure casting technique. The exit of the crystal rise part is vertically downward and can be applied to the gravity casting technique. Certainly, because the height of the vertical part is over double the height of the pressure supplying cylinder, the liquid level of the top of the crystallization treater 30 is the same as the pressure supplying cylinder. The exit of the crystal rise part is vertically upward and is also suitable for the gravity casting technique.

3. The L-Shaped Liquid Storage Cylinder and the Pressure Supplying Cylinder are suitable for Different Sizes of Cast Parts.

The pressure supplying cylinder 20 is used for filling and maintaining the pressure to meet the casting requirements of the small cast part. To the casting of the large cast part, the first passage and the second passage are opened till the liquid level of the vertical tube part is reduced to the lower limit; the first passage is closed; the pressure supplying cylinder provides the air pressure power, such that the melt continues to fill the mold cavity. The total capacity of the melt in the casting device is equal to the weight of the melt obtained by multiplying the total volume of the crystallization treater 30, the pressure supplying cylinder 20, and the L-shaped liquid storage cylinder 10 by the alloy density. In view of a limit situation that the net weight is close to the total capacity of the melt of the casting device, firstly the pressure gas of the pressure supplying cylinder enters the crystallization treater through the second passage and forces the most of the melt of the crystallization treater to be filled into the mold cavity; when the distance between the gas-liquid interface of the crystallization treater and the exit of the crystal rise part is equal to a pressure maintenance distance, the pressure is continuously maintained till the cast part is solidified.

The combined design of the above 1 to 3 items helps the casting device of a large non-ferrous metal thin-walled structural component to solve the above technical problems. By using the above composite casting technique of low-pressure casting in combination with the inclined-rotation type filling, the mold cavity obtains the low vacuum degree (negative pressure) in a short time. So, the air in the sand mold cavity is reduced, and the air content of the aluminum alloy liquid is also reduced. The pressure is quickly formed after vacuum low-pressure pouring, such that the cast part is crystallized under the pressure. Thus, the porosity of the cast part is reduced, the defects of shrinkage cavity and shrinkage porosity of the cast part are eliminated, and the high-quality aluminum-alloy bolster cast part is obtained.

What is claimed is:

1. A casting device of a large non-ferrous metal thin-walled structural component, wherein a liquid outlet of the casting device is communicated with a casting sand box, and a pouring system and a mold cavity are communicated and are arranged in the casting sand box; the casting device comprises:

an L-shaped liquid storage cylinder (10), wherein protective gas with a first gas pressure is inflated into a top of the L-shaped liquid storage cylinder (10); the L-shaped liquid storage cylinder is used for filling a molten metal stored in the L-shaped liquid storage cylinder into the mold cavity under a drive of the first gas pressure;

a pressure supplying cylinder (20), wherein the pressure supplying cylinder (20) and the L-shaped liquid storage cylinder (10) are integrally connected; protective gas with a second gas pressure is inflated into a top of the pressure supplying cylinder (20); the pressure supplying cylinder is used for maintaining a pressure of and feeding the second gas pressure to the mold cavity that is wholly filled with the molten metal through a crystallization treater (30), until the molten metal in the mold cavity is solidified completely; wherein the crystallization treater (30) is provided with a grain refining mechanism for conducting micro-alloying treatment on the molten metal that flows through the crystallization treater, and comprises a crystal rise part (32) that is extended vertically upward or downward, and wherein a liquid inlet of the crystallization treater is communicated with the pressure supplying cylinder while the liquid outlet is communicated with the pouring system and the mold cavity;

wherein the L-shaped liquid storage cylinder (10) comprises a vertical tube part (11) and an L-extension part (12); a first pas flow path is arranged at a top of the vertical tube part; a top wall of the L-extension part (12) and the pressure supplying cylinder (20) are integrally connected; the pressure supplying cylinder (20) is communicated with the L-extension part (12) through a first passage (21); and the pressure supplying cylinder (20) is communicated with the crystallization treater (30) through a second passage (22).

2. The casting device of a large non-ferrous metal thin-walled structural component according to claim 1, wherein the crystallization treater (30) comprises a sequentially and integrally connected influent tapered adapter (33) utilizing a first horizontal axis (d) as a rotation axis, a crystallization treatment part (31) utilizing a tilt axis (a) as the rotation axis, the crystal rise part (32) utilizing the vertical axis (b) as the rotation axis, and an effluent adapter (34) utilizing the second horizontal axis (c) as the rotation axis; the first horizontal axis (d), the tilt axis (a), and the vertical axis (b) are located on a main plane, and the second horizontal axis (c) is vertical to the main plane; the pressure supplying cylinder (20) comprises an effluent countersink (23) in communication with the second passage (22); the crystallization treater (30) is inserted into the effluent countersink (23) through the influent tapered adapter (33) in a liquid seal manner to communicate with the pressure supplying cylinder (20).

3. The casting device of a large non-ferrous metal thin-walled structural component according to claim 2, wherein the grain refining mechanism comprises an ultrasonic vibration mechanism (40) and a cooling mechanism (50); the ultrasonic vibration mechanism (40) comprises a first ultrasound (41) and a second ultrasound (42); the first ultrasound (41) is arranged at the connection part of the crystallization treatment part (31) and the crystal rise part (32) and is coaxial with the tilt axis (a); the second ultrasound (42) is arranged at a top of the effluent adapter (34) and is coaxial with the crystal rise part (32); the cooling mechanism (50) comprises a first cooling mechanism (51) and a second cooling mechanism (52) sequentially in a molten metal flowing direction; the first cooling mechanism (51) is arranged around the outer wall of the crystallization treatment part (31); the second coaling mechanism (52) is arranged around the outer wall of the crystal rise part (32).

4. The casting device of a large non-ferrous metal thin-walled structural component according to claim 2, wherein a height of the vertical tube part (11) is more than twice a height of the pressure supplying cylinder (20).

5. The casting device of a large non-ferrous metal thin-walled structural component according to claim 2, wherein an L-shaped sprue (35) rotatably sleeves the effluent adapter (34); the L-shaped sprue (35) comprises a sequentially and integrally connected transfer sleeve (36) and a main sprue (37); side flanges are arranged on two sides of the transfer sleeve (36); liquid sealing asbestos is embedded in an end face of each of the side flanges; the transfer sleeve (36) sleeves a periphery of the effluent adapter (34); a cylinder part of a pressing end cap abuts against the effluent adapter and is fixedly connected with the effluent adapter through bolts, such that the side flanges of the transfer sleeve (36) relatively rotate and also seal the molten metal.

6. The casting device of a large non-ferrous metal thin-walled structural component according to claim 5, wherein the grain refining mechanism comprises an ultrasonic vibration mechanism (40) and a cooling mechanism (50); the ultrasonic vibration mechanism (40) comprises a first ultrasound (41) and a second ultrasound (42); the first ultrasound (41) is arranged at the connection part of the crystallization treatment part (31) and the crystal rise part (32) and, is coaxial with the tilt axis (a); the second ultrasound (42) is arranged at a top of the effluent adapter (34) and is coaxial with the crystal rise part (32); the cooling mechanism (50) comprises a first cooling mechanism (51) and a second cooling mechanism (52) sequentially in a molten metal flowing direction; the first cooling mechanism (51) is arranged around the outer wall of the crystallization treatment part (31); the second cooling mechanism (52) is arranged around the outer wall of the crystal rise part (32).

7. The casting device of a large non-ferrous metal thin-walled structural component according to claim 5, wherein a height of the vertical tube part (11) is more than twice a height of the pressure supplying cylinder (20).

8. The casting device of a large non-ferrous metal thin-walled structural component according to claim 5, wherein the casting sand box (1) is arranged on a track car in an inclined manner; a back-side-wall lower corner of the casting sand box (1) is fixedly connected with an insertion cone (2) in communication with a sprue; the main sprue (37) of the L-shaped sprue (35) is inserted into a conical hole of the insertion cone (2) and abuts against the wall of the casting sand box, such that the crystallization treater is communicated with the pouring system and the mold cavity.

9. The casting device of a large non-ferrous metal thin-walled structural component according to claim 8, wherein the grain refining mechanism comprises an ultrasonic vibration mechanism (40) and a cooling mechanism (50), the ultrasonic vibration mechanism (40) comprises a first ultrasound (41) and a second ultrasound (42); the first ultrasound (41) is arranged at the connection part of the crystallization treatment part (31) and the crystal rise part (32) and is coaxial with the tilt axis (a); the second ultrasound (42) is arranged at a top of the effluent adapter (34) and is coaxial with the crystal rise part (32); the cooling mechanism (50) comprises a first cooling mechanism (51) and a second cooling mechanism (52) sequentially in a molten metal flowing direction; the first cooling mechanism (51) is arranged around the outer wall of the crystallization treatment part (31); the second cooling mechanism (2) is arranged around the outer wall of the crystal rise part (32).

10. The casting device of a large non-ferrous metal thin-walled structural component according to claim 8, wherein a height of the vertical tube part (11) is more than twice a height of the pressure supplying cylinder (20).

11. The casting device of a large non-ferrous metal thin-walled structural component according to claim 8, wherein the casting sand box (1) has an inclined butt joint state, a filling rotation state, and a horizontal pressure maintenance state; in the inclined butt joint state, the casting sand box (1) on the track car rotates to form a casting angle of inclination (α) with a horizontal plane and is communicated with the crystallization treater (30) through the L-shaped sprue (35); in the filling rotation state, the casting sand box (1) is vacuumized, the molten metal in the crystallization treater (30) continuously flows into the mold cavity through the main sprue, and such filling process accompanies with an operation that the casting sand box (1) and the insertion cone (2) force the L-shaped sprue (35) to rotate around the effluent adapter (34) until the casting sand box is horizontal; in the horizontal pressure maintenance state, the pressure supplying cylinder (20) provides the second gas pressure to force the molten metal in the mold cavity, the sprue and the main sprue (37) in the horizontal pressure maintenance state until a pouring gate is solidified.

12. The casting device of a large non-ferrous metal thin-walled structural component according to claim 11, wherein the grain refining mechanism comprises an ultrasonic vibration mechanism (40) and a cooling mechanism (50); the ultrasonic vibration mechanism (40) comprises a first ultrasound (41) and a second ultrasound (42); the first ultrasound (41) is arranged at the connection part of the crystallization treatment part (31) and the crystal rise part (32) and is coaxial with the tilt axis (a); the second ultrasound (42) is arranged at a top of the effluent adapter (34) and is coaxial with the crystal rise part (32); the cooling mechanism (50) comprises a first cooling mechanism (51) and a second cooling mechanism (52) sequentially in a molten metal flowing direction; the first cooling mechanism (51) is arranged around the outer wall of the crystallization treatment part (31); the second cooling mechanism (52) is arranged around the outer wall of the crystal rise part (32).

13. The casting device of a large non-ferrous metal thin-walled structural component according to claim 11, wherein a height of the vertical tube part (11) is more than twice a height of the pressure supplying cylinder (20).

14. The casting device of a large non-ferrous metal thin-walled structural component according to claim 1, wherein a height of the vertical tube part (11) is more than twice a height of the pressure supplying cylinder (20).

15. A low-pressure casting method of the casting device of a large non-ferrous metal thin-walled structural component according to claim 1, wherein the exit of the crystal rise part (32) is vertically upward; the method comprising:

arranging the casting sand box (1) on a track car in an inclined manner by forming an intersection angle, wherein the intersection angle is a casting angle of inclination (α), with a horizontal plane, and wherein the casting sand box (1) moves along a track with the track car;

controlling the track car to move along the track until the pouring system is communicated to the crystallization treater (30);

starting the grain refining mechanism;

controlling a temperature of the molten metal at the liquid inlet of the crystallization treater (30) to be 100-120° C. higher than the alloy liquidus temperature of the non-ferrous metal;

controlling a temperature of the molten metal at the liquid outlet to be 80-90° C. higher than the alloy liquidus temperature of the non-ferrous metal;

communicating the L-shaped liquid storage cylinder (10) with the crystallization treater (30) by using the pressure supplying cylinder (20);

pressurizing the top of the L-shaped liquid storage cylinder (10) by a gas from a first gas flow path (8);

filling the molten metal into the mold cavity until the mold cavity is completely filled with the molten metal;

accompanying a whole filling process of the molten metal into the mold cavity;

controlling the casting sand box (1) to start rotating from the casting angle of inclination (α) to be horizontal;

closing communication of the pressure supplying cylinder (20) with the L-shaped liquid storage cylinder (10) while maintaining communication with the crystallization treater (30);

pressurizing a top of the molten metal in the pressure supplying cylinder (20) by a gas from a second gas flow path (9); and finishing such pressure maintenance operation until a large aluminum-alloy thin-walled structural component is sequentially solidified to a pouring gate.

16. A gravity casting method of the casting device of a large non-ferrous metal thin-walled structural component according to claim 1, wherein the exit of the crystal rise part (32) is vertically downward, the method comprising:

arranging the casting sand box (1) on a track car in an inclined manner by forming an intersection angle, wherein the intersection angle is a casting angle of inclination (α), with a horizontal plane, wherein the casting sand box (1) moves along a track with the track car;

controlling the track car to move along the track until the pouring system is communicated to the crystallization treater (30);

starting the grain refining mechanism;

controlling a temperature of the molten metal at the liquid inlet of the crystallization treater (30) to be 100-120° C. higher than the alloy liquidus temperature of the non-ferrous metal;

controlling a temperature of the molten metal at the liquid outlet to be 80-90° C. higher than the alloy liquidus temperature of the non-ferrous metal;

communicating the L-shaped liquid storage cylinder (10) with the crystallization treater (30) by using the pressure supplying cylinder (20), wherein at this time, the molten metal flows out of the crystallization treater under the action of gravity to fill the mold cavity until the mold cavity is completely filled with the molten metal;

accompanying a whole filling process of the molten metal into the mold cavity;

controlling the casting sand box (1) to start rotating from the casting angle of inclination ($\alpha$) to be horizontal;

maintaining communication of the pressure supplying cylinder (20) with the L-shaped liquid storage cylinder (10) and the crystallization treater (30); and finishing a gravity pressure maintenance until a large aluminum-alloy thin-walled structural component is sequentially solidified to a pouring gate.

* * * * *